US008715494B2

(12) United States Patent
Danov et al.

(10) Patent No.: US 8,715,494 B2
(45) Date of Patent: May 6, 2014

(54) DEVICE FOR SEPARATING FERROMAGNETIC PARTICLES FROM A SUSPENSION

(75) Inventors: Vladimir Danov, Erlangen (DE); Werner Hartmann, Weisendorf (DE); Heinz Schmidt, Möhrendorf (DE); Andreas Schröter, Anrode/Bickenriede (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/642,607

(22) PCT Filed: Mar. 7, 2011

(86) PCT No.: PCT/EP2011/053351

§ 371 (c)(1), (2), (4) Date: Oct. 22, 2012

(87) PCT Pub. No.: WO2011/131411

PCT Pub. Date: Oct. 27, 2011

(65) Prior Publication Data

US 2013/0037472 A1 Feb. 14, 2013

(30) Foreign Application Priority Data

Apr. 22, 2010 (DE) ..... 10 2010 017 957

(51) Int. Cl.

| | |
|---|---|
| ***B03C 1/24*** | (2006.01) |
| ***B03C 1/28*** | (2006.01) |
| ***B03C 1/253*** | (2006.01) |
| ***B03C 1/033*** | (2006.01) |

(52) U.S. Cl.

CPC ... *B03C 1/24* (2013.01); *B03C 1/28* (2013.01); *B03C 1/253* (2013.01); *B03C 1/033* (2013.01)

USPC ..... 210/143; 210/222; 210/416.1; 209/227; 209/229; 209/232

(58) Field of Classification Search

CPC ..... B03C 1/24; B03C 1/28; B03C 1/253; B03C 1/033

USPC ..... 210/222, 416.1, 695, 143; 209/227, 209/229, 232

See application file for complete search history.

(56) References Cited

U.S. PATENT DOCUMENTS

| | | | | |
|---|---|---|---|---|
| 2,678,728 | A | 5/1954 | Spodig | 210/223 |
| 3,294,237 | A | 12/1966 | David | 209/214 |

(Continued)

FOREIGN PATENT DOCUMENTS

| | | | | |
|---|---|---|---|---|
| DE | 271116 | C | 3/1913 | B03C 1/03 |
| DE | 1809982 | A1 | 10/1970 | B02B 1/02 |
| DE | 2651137 | A1 | 5/1977 | B03C 1/0355 |
| DE | 102008047851 | A1 | 4/2010 | B03C 1/00 |

(Continued)

OTHER PUBLICATIONS

International Search Report and Written Opinion, Application No. PCT/EP2011/053351, 14 pages, May 2, 2011.

*Primary Examiner* — David A Reifsnyder

(74) *Attorney, Agent, or Firm* — King & Spalding L.L.P.

(57) ABSTRACT

A device for separating ferromagnetic particles from a suspension may include a tubular reactor through which the suspension can flow and which has an inlet and an outlet, and a means for generating a magnetic field, which means is designed to generate a magnetic travelling field which acts on the reactor.

12 Claims, 4 Drawing Sheets

(56) References Cited

U.S. PATENT DOCUMENTS

| | | | | |
|---|---|---|---|---|
| 4,239,619 | A | 12/1980 | Aplan et al. | 209/214 |
| 4,921,597 | A | 5/1990 | Lurie | 209/223.2 |
| 6,346,196 | B1 | 2/2002 | Bose | 210/695 |
| 2011/0168607 | A1 | 7/2011 | Ries | 209/212 |
| 2011/0168618 | A1 | 7/2011 | Danov et al. | 210/222 |
| 2013/0037472 | A1 | 2/2013 | Danov et al. | 210/223 |

FOREIGN PATENT DOCUMENTS

| | | | | |
|---|---|---|---|---|
| DE | 102008047852 | A1 | 4/2010 | B03C 1/00 |
| EP | 1974821 | A1 | 10/2008 | B03C 1/253 |
| GB | 2333978 | A | 8/1999 | B03C 1/24 |
| JP | 58008563 | A | 1/1983 | B03C 1/23 |
| WO | 99/07897 | A1 | 2/1999 | B03C 1/01 |
| WO | 02/07889 | A2 | 1/2002 | B03C 1/14 |
| WO | 2010/031613 | A1 | 3/2010 | B03C 1/24 |
| WO | 2011/131411 | A1 | 10/2011 | B03C 1/0355 |

DEVICE FOR SEPARATING FERROMAGNETIC PARTICLES FROM A SUSPENSION

CROSS-REFERENCE TO RELATED APPLICATIONS

This application is a U.S. National Stage Application of International Application No. PCT/EP2011/053351 filed Mar. 7, 2011, which designates the United States of America, and claims priority to DE patent application Ser. No. 10 2010 017 957.4 filed Apr. 22, 2010. The contents of which are hereby incorporated by reference in their entirety.

TECHNICAL FIELD

This disclosure n relates to a device for separating ferromagnetic particles from a suspension, comprising a tubular reactor through which the suspension can flow and which has an inlet and an outlet, and a means for generating a magnetic field.

BACKGROUND

In order to extract ferromagnetic constituents retained in ores, the ore is ground and the powder obtained is mixed with water. This suspension is exposed to a magnetic field that is generated by a magnet or a plurality of magnets, so that the ferromagnetic particles are attracted and can thus be separated from the suspension.

A device for separating ferromagnetic particles from a suspension, in which a drum consisting of iron bars is used, is known from DE 27 11 16 A. The iron bars are alternately magnetized during the rotation of the drum, so that the ferromagnetic particles adhere to the iron bars, while other constituents of the suspension drop down between the iron bars.

A device for separating magnetic particles from an ore material in which the suspension is passed through a tube which is surrounded by a solenoid, is described in DE 26 51 137 A1. The ferromagnetic particles accumulate at the edge of the tube, other particles are separated by a central tube located inside the first tube.

A magnetic separator is described in U.S. Pat. No. 4,921, 597 B. The magnetic separator has a drum on which is arranged a plurality of magnets. The drum is rotated in the opposite direction to the flow of the suspension, so that ferromagnetic particles adhere to the drum and are separated from the suspension.

A method for the continuous magnetic separation of suspensions is known from WO 02/07889 A2. Here a rotatable drum is used, in which a permanent magnet is mounted in order to separate ferromagnetic particles from the suspension.

With the known devices and methods there is sometimes the problem that sand and other unwanted constituents contained in the ground ore, which adhere to the ferromagnetic particles, are also separated, which is why the purity of the separated fraction of the ferromagnetic particles is inadequate.

SUMMARY

In one embodiment, a device is provided for separating ferromagnetic particles from a suspension, having a tubular reactor through which the suspension can flow, and having an inlet and an outlet, and a means for generating a magnetic field, wherein the means is embodied to generate a traveling magnetic field which acts on the reactor.

In a further embodiment, an annular orifice plate for separating ferromagnetic particles and non-magnetic constituents of the suspension, is arranged at the outlet. In a further embodiment, the aperture cross-section of the orifice plate can be controlled. In a further embodiment, the aperture cross-section of the orifice plate can be controlled in accordance with the existing amplitude and/or phase of the traveling magnetic field. In a further embodiment, the orifice plate can be fully closed. In a further embodiment, the device has a valve for opening and closing the orifice plate. In a further embodiment, the valve has bellows for adjusting the aperture cross-section, which can be actuated electromagnetically or pneumatically or hydraulically. In a further embodiment, the bellows comprises an elastic material, in particular an elastomer. In a further embodiment, the device has a pump whose suction end leads into the reactor. In a further embodiment, the pump can be controlled in accordance with the existing amplitude and/or phase of the traveling field. In a further embodiment, the pump is embodied as a diaphragm pump. In a further embodiment, the swept volume of the diaphragm pump is chosen so that the magnetic constituents which are discontinuously conveyed by the traveling magnetic field are essentially drawn off. In a further embodiment, the device has a pump or a diaphragm pump for conveying the separated magnetic constituents, which is connected to a bypass line in which a restrictor is located.

BRIEF DESCRIPTION OF THE DRAWINGS

Example embodiments will be explained in more detail below with reference to figures, in which.

DETAILED DESCRIPTION

Figure 1:
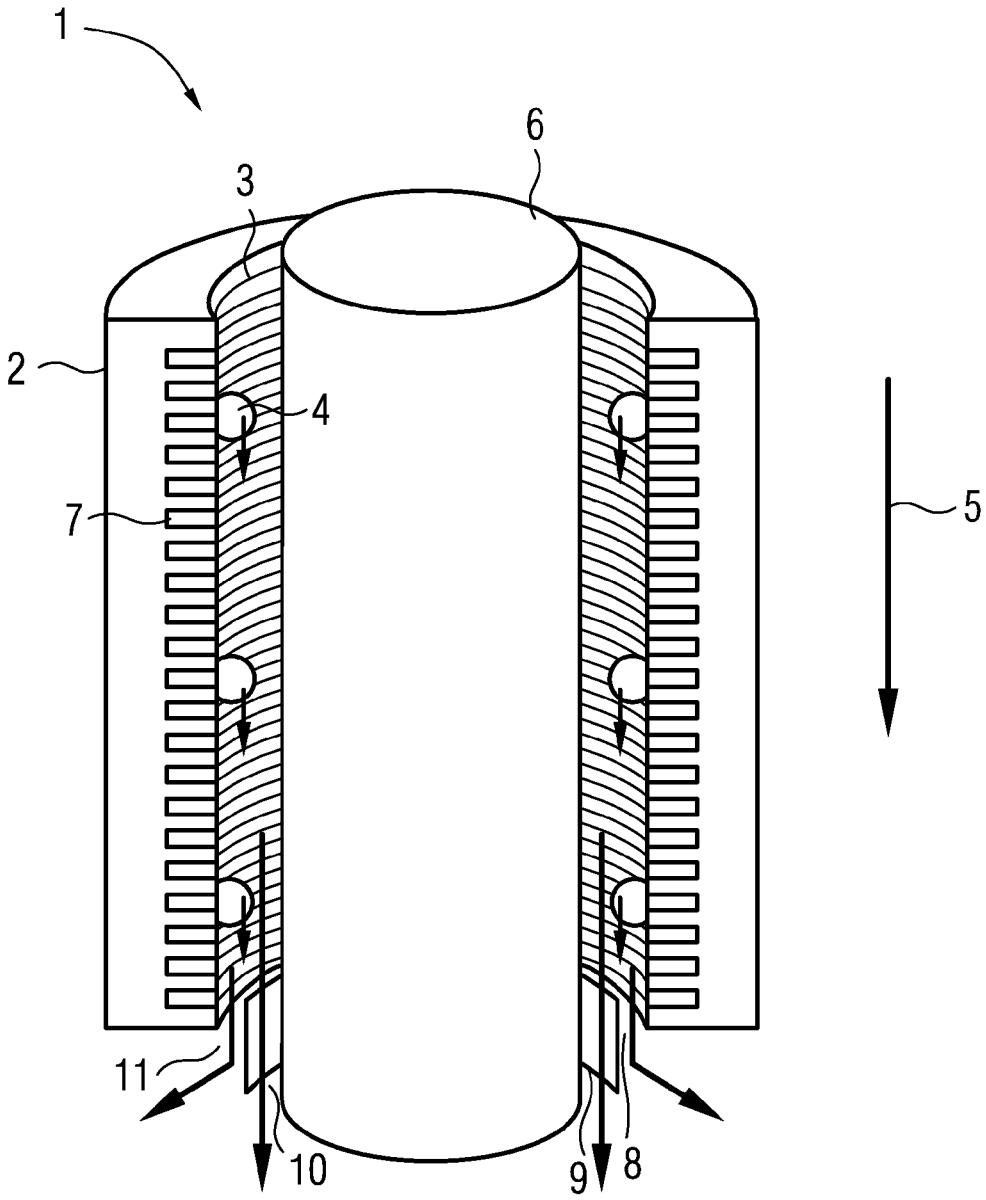
FIG. 1 shows a partially sectional, perspective view of a device according to a first example embodiment.

Certain embodiments are based on the problem of specifying a device for separating ferromagnetic particles from a suspension, which is able to separate ferromagnetic particles with high purity.

Thus, some embodiments provide a device that embodies the means for generating a traveling magnetic field which acts on the reactor.

Aspects of the present disclosure are based on the idea that the ferromagnetic particles are concentrated by the externally generated traveling magnetic field which acts on the suspension which can thus be separated with higher purity. Here the traveling magnetic field moves essentially in the longitudinal direction of the reactor from inlet to outlet and the ferromagnetic particles are separated from the suspension at this point. In this case the characteristic of the travelling magnetic field or the characteristic of the magnetic field strength corresponds to a sine function, with the field strength varying between a low value and a high value and this transition occurring continuously.

In the time intervals in which there is a high magnetic field strength in the traveling field, the ferromagnetic particles are radially displaced outwards inside the reactor, so that they gradually accumulate at the inner wall of the reactor. The ferromagnetic particles can then be separated in the region of the outlet of the reactor.

In some embodiments of he device, a cylindrical displacer may be arranged in the tubular reactor. The displacer acts to direct the suspension in the reactor through an annular gap. In such embodiments of the inner space of the reactor, the traveling magnetic field can have an influence on practically the entire suspension.

Also, an annular orifice plate may be arranged at the outlet to separate magnetic and non-magnetic constituents of the suspension. Due to the traveling magnetic field, the concentration of the ferromagnetic particles flowing at the outlet fluctuates. It may therefore be advantageous if the ferromagnetic particles are separated when their concentration is high and they are not separated when their concentration is low. The orifice plate can be opened when the concentration of the ferromagnetic particle flow is high and the orifice plate can be closed when the instantaneous concentration of ferromagnetic particles is low. In this connection, there can also be provision for the orifice plate aperture cross-section to be controllable in order to set intermediate stages between a fully open or fully closed orifice plate.

In some embodiments, the orifice plate aperture cross-section can be controlled in accordance with the existing amplitude or phase of the traveling field. In this way, the control of the orifice plate can be matched to the traveling magnetic field so that separation of the ferromagnetic particles occurs, e.g., when their concentration is high and is accompanied by a correspondingly strong, local travelling magnetic field at the outlet.

The orifice plate may be fully closeable. Full closing of the orifice plate can be useful if the proportion of the ferromagnetic particles in the suspension flowing at the outlet at a given instant is very small.

In order to facilitate the separation of the ferromagnetic matter, the device may include a valve to open and close the orifice plate. In a further embodiment, the valve can have bellows for adjusting the cross-section of the aperture, which bellows can be actuated electromagnetically, or pneumatically or hydraulically. The annular gap or annular cross-section in the region of the outlet of the reactor can be fully or partially closed by means of these bellows.

In some embodiments, the bellows comprise an elastic material, e.g., an elastomer. An elastomer bellows can cling closely to the curved contour of the displacer and seal the annular gap in this way. As an alternate to the adjustable orifice plate described, the device may have a suction pump whose suction end leads into the reactor. The ferromagnetic particles, which are displaced outwards to the inner wall of the tubular reactor, are sucked out by the suction pump. It is useful if the suction pump is arranged in the region of the reactor outlet. The ferromagnetic particles are separated from the suspension by the vacuum produced by the suction pump.

The suction pump may be controlled in accordance with the existing amplitude and/or phase of the traveling field. Due to the timed coordination of the suction process by the suction pump and the attraction of the ferromagnetic particles by the traveling field, the suction pump can be controlled so that it then draws off the ferromagnetic particles precisely when these are flowing at an increased concentration at the suction side.

In some embodiments the suction pump may be embodied as a diaphragm pump. The diaphragm pump can be controlled so that the pump movement is synchronized with the traveling magnetic field.

The swept volume of the diaphragm pump may be selected such that the magnetic constituents which are discontinuously conveyed by the traveling magnetic field are essentially drawn off. This matching of the swept volume of the diaphragm pump to the traveling magnetic field results in a particularly good efficiency in the separation of the ferromagnetic particles.

Further, the device may include a pump for conveying the separated magnetic constituents, said pump being connected to a bypass line. The pump prevents the separated ferromagnetic particles from being deposited in a pipeline and blocking it. Continuous conveying of the separated ferromagnetic particles is achieved by means of the bypass. A restrictor by which the flow in the bypass line can be regulated, can be located in the bypass line.

The example device 1 shown in FIG. 1 comprises a reactor 2 of a tubular form. A suspension, which contains ferromagnetic particles 4 and unwanted constituents such as sand, ore, etc., is conveyed to the reactor 2 via an inlet 3. In the schematic representation of FIG. 1, a few ferromagnetic particles 4 are shown in spherical form by way of example, however, the unwanted constituents of the suspension are not shown. The suspension flows through the reactor 2 in the direction of the arrow 5. A cylindrical displacer 6 is located in the centre of the reactor 2, so that an annular gap through which the suspension flows is formed inside the reactor 2. A traveling field magnet 7, that can be actuated by an electrical or electronic controller in such a way that it generates a traveling magnetic field which is moved in the longitudinal direction of the reactor 2, is located in the wall of the tubular reactor 2. The traveling magnetic field causes the ferromagnetic particles 4 to be concentrated at the inner wall of the reactor 2. While flowing through the reactor 2, the ferromagnetic particles are displaced radially outwards under the influence of the magnetic field. Because of the traveling magnetic field, however, the ferromagnetic particles 4 do not accumulate homogeneously at the inner wall of the reactor 2, rather, the suspension flow has sections with an increased concentration of ferromagnetic particles, as well as sections with a reduced concentration of ferromagnetic particles.

An orifice plate 9 to separate ferromagnetic particles and non-magnetic particles from one another is arranged in the region of an outlet 8 of the reactor 2. As FIG. 1 shows, the annular orifice plate 9 divides the annular space between the inside of the reactor 2 and the displacer 6 into two concentric annular gaps 10, 11. In the outer annular gap 11, the concentration of the ferromagnetic particles is higher than in the inner annular gap 10. The fraction of the suspension in the outer annular gap 11 is separated at or after passing the orifice plate 9.

Figure 2:
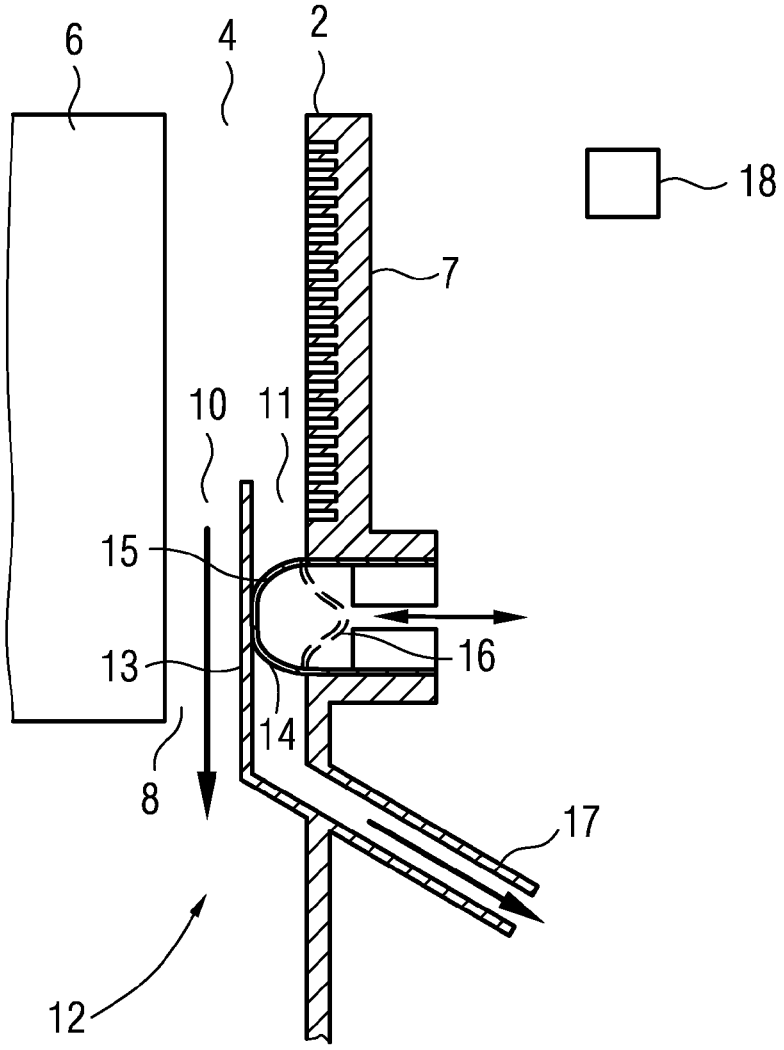
FIG. 2 shows a sectional view of a device according to a second example embodiment.

FIG. 2 shows a further exemplary embodiment of a device for separating ferromagnetic particles from a suspension, with the same reference numbers as in FIG. 1 being used for corresponding components. In accordance with the first exemplary embodiment, the device 12 which is represented only partially and in sectional form in FIG. 2, includes the reactor 2 with the traveling field magnet 7 and the displacer 6. An orifice plate 13 which divides the inner space of the reactor 2 into an inner annular gap 10 and an outer annular gap 11, is located in the lower part of the reactor 2, in the region of the outlet 8. The aperture cross-section of the outer annular gap 11 can be adjusted by means of a valve that is embodied as bellows 14. The bellows comprise an elastic material, for example an elastomer, and can be moved between a closed position 15 and an open position 16, depicted by a broken line. In the closed position 15 the flow through the outer annular gap 11 is prevented, in the open position 16 the fraction of the suspension with a high proportion of ferromagnetic particles 4 can pass through the outer annular gap 11 and be removed via a pipeline 17 in the direction of the arrow.

In the illustrated exemplary embodiment, the drive for the bellows 14 is realized electromechanically, for example by a plunger moved to and fro by an electric motor.

Alternately, the bellows 14 can also be moved pneumatically between the closed position 15 and the open position 16. The bellows extend in the circumferential direction over the entire periphery of the reactor 2, so that the ferromagnetic material 4 can be separated at the whole of the circumferential surface. The device 12 further includes a controller 18 which is connected via electrical leads (not shown) to the traveling field magnet 7 and to the bellows 14. The traveling magnetic field generated by the traveling field magnets 7 is synchronized to the opening and closing movement of the bellows 14 by means of the controller 18. The synchronization is realized in such a way that the bellows are opened when the proportion of the ferromagnetic particles in the suspension is high, and similarly the bellows 14 are fully or partially closed when the proportion of the ferromagnetic particles of the suspension passing the outlet 8 at any given instant is low.

Figure 3:
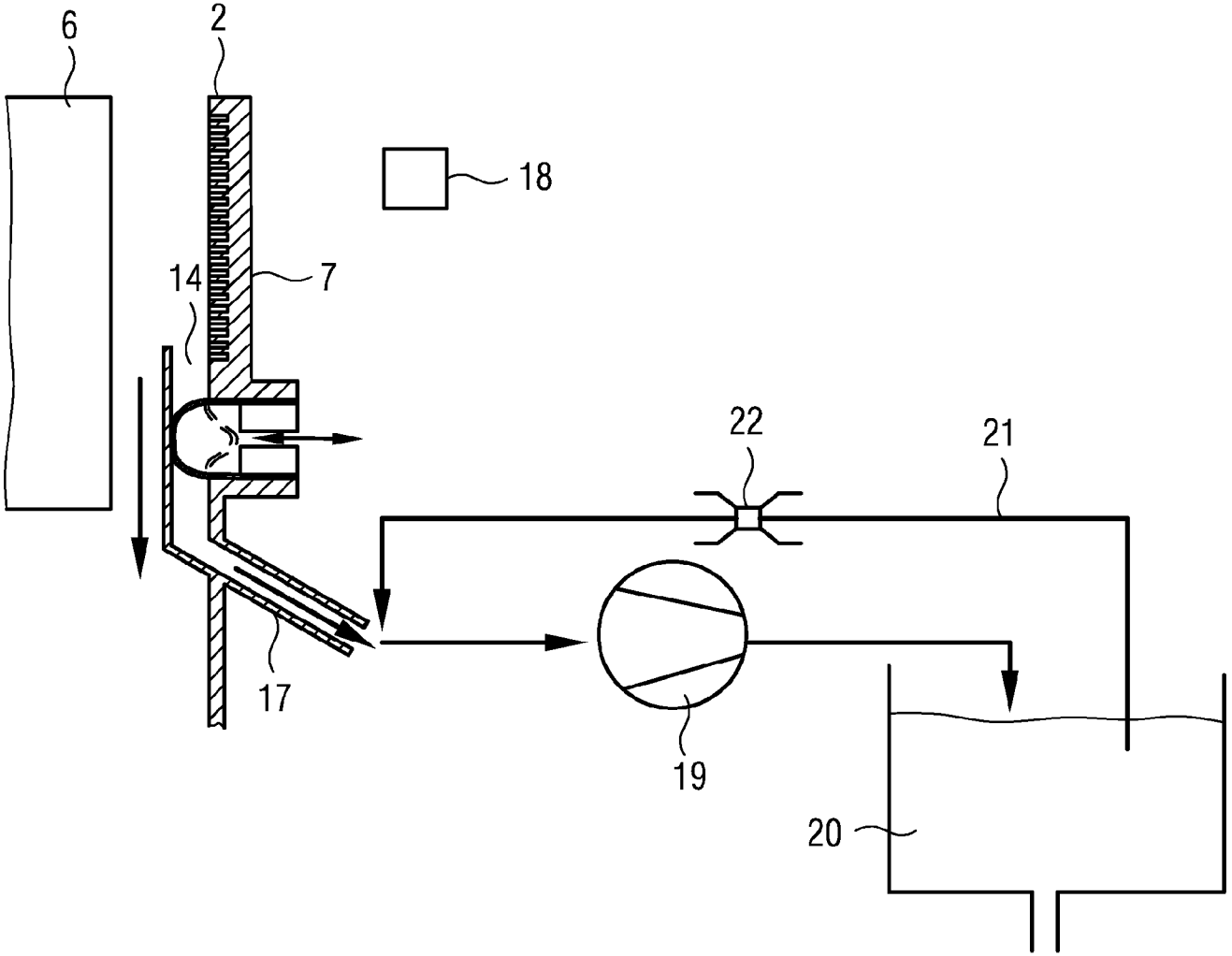
FIG. 3 shows a variant of the example embodiment shown in FIG. 2.

FIG. 3 shows a variant of the exemplary embodiment shown in FIG. 2, in which a pump 19 is located in the pipeline 17. The pump 19 conveys the separated fraction of the suspension to a storage tank 20 in which the ferromagnetic particles are made available for further method steps. A bypass line 21, via which the fraction of the ferromagnetic particles is again conveyed in the pipeline 17, branches off from the storage tank 20. It is ensured in this way that the separated fraction of the ferromagnetic particles is permanently in motion, which prevents blocking of the pipeline 17 itself in the event of prolonged downtimes. A restrictor 22, by which the cross-section of the bypass line 21 is adjusted so that a specific flow rate is obtained, is located in the bypass line 21. Due to the bypass line 21, material is then also transported into the pipelines when the bellows 14 are in the closed position.

Figure 4:
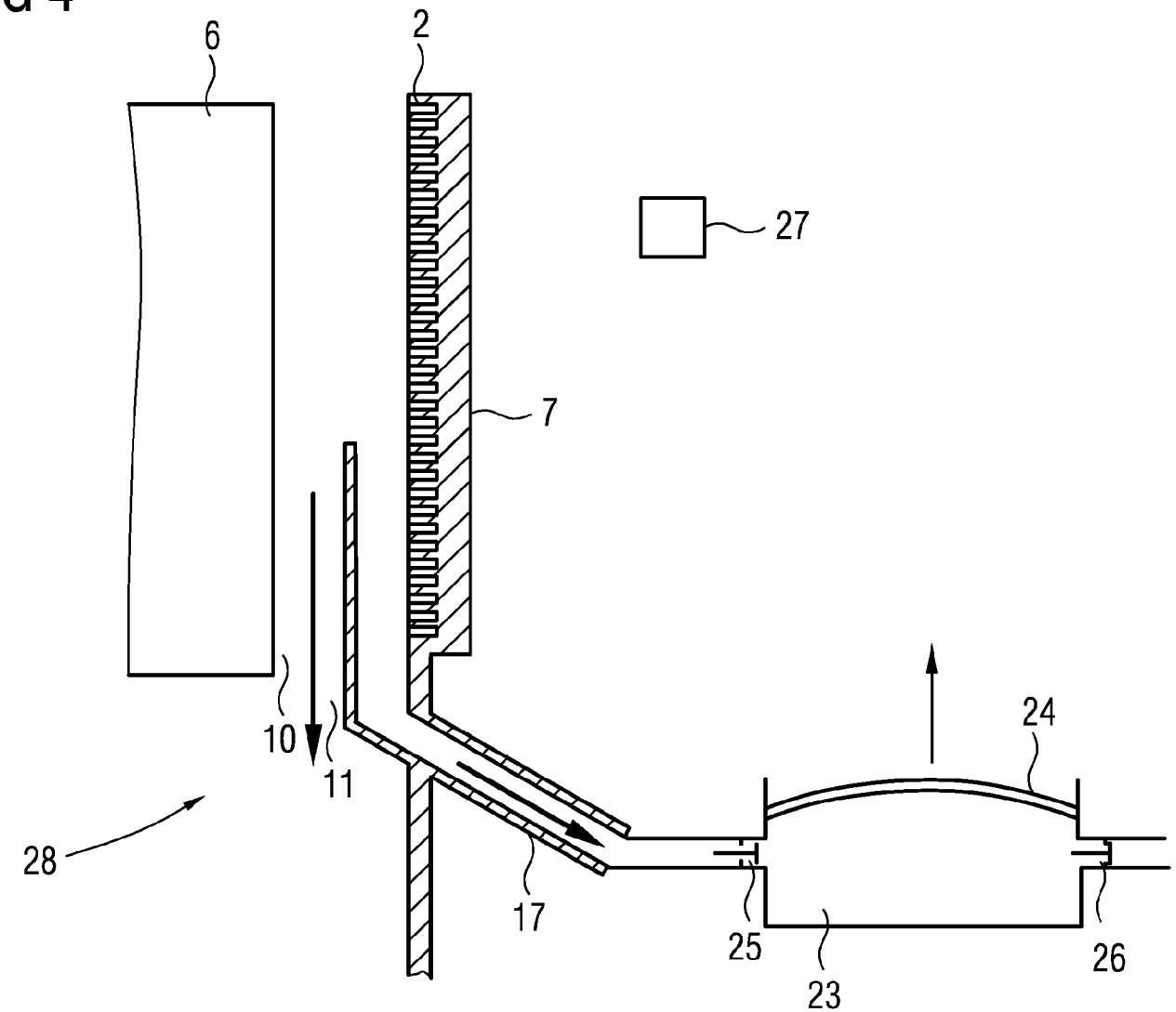
FIG. 4 shows a further example embodiment of a device according to another embodiment.

FIG. 4 shows a further exemplary embodiment of a device 28, whose reactor 2 is constructed like the reactor 2 shown in FIG. 1. Unlike the preceding exemplary embodiment, the separated fraction of the suspension is sucked out by means of a diaphragm pump 23. The diaphragm pump 23 is integrated in the pipeline 17, so that the separated fraction of the suspension flows through the diaphragm pump 23. Due to the movement of a moving diaphragm 24 and the coordinated control of valves 25, 26, the suspension is conveyed and sucked out in the direction of the arrow. A controller 27 that is connected to the traveling field magnet 7 and the diaphragm pump 23, ensures that the pumping movement of the diaphragm pump 23 and the traveling magnetic field are synchronized in such a way that a pump stroke of the diaphragm pump 23 occurs when the suspension with the increased proportion of ferromagnetic particles is flowing through the outer annular gap 11.

What is claimed is:

1. A device for separating ferromagnetic particles from non-magnetic particles mixed in a suspension, comprising:

a tubular reactor through which the suspension can flow, the tubular reactor comprising an inlet for the suspension and an outlet, an orifice plate comprising a hollow cylindrical insert disposed at least partially within the outlet of the tubular reactor, the hollow cylindrical insert defining an annular inner path closer to a center of the tubular reactor and an annular outer path closer to an exterior wall of the tubular reactor, a variable aperture disposed in the annular outer path of the outlet and configured to selectively allow flow through the annular outer path of the outlet, and a magnet disposed on the exterior of the tubular reactor to apply a variable strength traveling magnetic field to the suspension flowing through the tubular reactor.

2. The device of claim 1, wherein a cross-section of the variable aperture is controllable, thereby controlling a cross-section of the annular outer path.

3. The device of claim 2, wherein the cross-section of the variable aperture is controllable based on an existing amplitude or phase of the traveling magnetic field.

4. The device of claim 2, wherein the variable aperture is fully closable.

5. The device of claim 2, comprising a valve for opening and closing the variable aperture.

6. The device of claim 5, wherein the valve comprises a bellows for adjusting the cross-section of the variable aperture, the bellows being actuated electromagnetically or pneumatically or hydraulically.

7. The device of claim 6, wherein the bellows comprises an elastic material.

8. The device of claim 1, comprising a pump having a suction end leading into the tubular reactor.

9. The device of claim 8, wherein the pump is controllable based on an existing amplitude or phase of the variable strength traveling magnetic field.

10. The device of claim 9, wherein the pump comprises a diaphragm pump.

11. The device of claim 10, wherein the diaphragm pump has a swept volume selected such that ferromagnetic particles that are discontinuously conveyed by the variable strength traveling magnetic field are essentially drawn off.

12. The device of claim 1, comprising a pump for conveying the separated ferromagnetic particles, the pump being connected to a bypass line in which a restrictor is located.

* * * * *